US006530574B1

(12) United States Patent
Bailey et al.

(10) Patent No.: US 6,530,574 B1
(45) Date of Patent: Mar. 11, 2003

(54) METHOD AND APPARATUS FOR EXPANSION SEALING CONCENTRIC TUBULAR STRUCTURES

(76) Inventors: Gary L. Bailey, 14826 Willow Bend, San Antonio, TX (US) 78232; Ross S. Woods, 4959 Shady Oak Trail, Grand Prairie, TX (US) 75052

( * ) Notice: Subject to any disclaimer, the term of this patent is extended or adjusted under 35 U.S.C. 154(b) by 117 days.

(21) Appl. No.: 09/684,412

(22) Filed: Oct. 6, 2000

(51) Int. Cl.[7] ..... E21B 33/127

(52) U.S. Cl. ..... 277/314; 277/334; 277/645; 277/627; 166/179; 166/195

(58) Field of Search ..... 277/314, 316, 277/332–4, 626, 627, 645, 646; 166/187, 179, 195; 285/216, 346, 338

(56) References Cited

U.S. PATENT DOCUMENTS

| | | | | | |
|---|---|---|---|---|---|
| 1,336,738 | A | * | 4/1920 | Fletcher | |
| 1,842,033 | A | * | 1/1932 | Lewis | |
| 2,742,968 | A | * | 4/1956 | Hildebrandt | |
| 3,272,517 | A | * | 9/1966 | Howard et al. | |
| 3,797,864 | A | | 3/1974 | Hynes et al. | 166/88 |
| 4,125,937 | A | | 11/1978 | Brown et al. | 29/727 |
| 4,138,144 | A | | 2/1979 | Pierce, Jr. | 285/17 |
| 4,288,082 | A | | 9/1981 | Setterberg, Jr. | 277/125 |
| 4,296,806 | A | | 10/1981 | Taylor | 166/120 |
| 4,414,739 | A | | 11/1983 | Kelly | 29/727 |
| 4,496,162 | A | | 1/1985 | McEver et al. | 277/9.5 |
| 4,505,017 | A | | 3/1985 | Schukei | 29/187 |
| 4,573,537 | A | | 3/1986 | Hirasuna et al. | 166/387 |
| 4,635,972 | A | | 1/1987 | Lyall | 285/242 |
| 4,651,818 | A | * | 3/1987 | Johnson et al. | 166/115 |
| 4,911,245 | A | | 3/1990 | Adamek et al. | 166/387 |
| 5,048,605 | A | * | 9/1991 | Toon et al. | 166/187 |
| 5,095,991 | A | * | 3/1992 | Milberger | 166/380 |
| 5,195,583 | A | * | 3/1993 | Toon et al. | 166/187 |
| 5,215,145 | A | | 6/1993 | Ross | 166/217 |
| 5,355,961 | A | | 10/1994 | Gariepy et al. | 166/387 |
| 5,464,063 | A | | 11/1995 | Boehm, Jr. | 166/382 |
| 5,494,106 | A | | 2/1996 | Gueguen et al. | 166/277 |
| 5,501,281 | A | | 3/1996 | White et al. | 166/387 |
| 5,775,429 | A | | 7/1998 | Arimendi | 166/387 |
| 5,941,313 | A | | 8/1999 | Arimendi | 166/387 |
| 5,997,003 | A | | 12/1999 | Turner | 277/339 |
| 6,003,600 | A | | 12/1999 | Nguyen et al. | 166/281 |
| 6,021,850 | A | | 2/2000 | Wood et al. | 166/380 |
| 6,026,899 | A | * | 2/2000 | Arizmendi et al. | 166/216 |
| 6,041,858 | A | | 3/2000 | Arizmendi | 166/187 |
| 6,070,671 | A | | 6/2000 | Cumming et al. | 166/381 |
| 6,098,717 | A | | 8/2000 | Bailey et al. | 166/382 |
| 6,102,407 | A | * | 8/2000 | Moriya et al. | 277/316 |
| 2002/0014339 | A1 | | 2/2002 | Ross | |

* cited by examiner

*Primary Examiner*—Anthony Knight
*Assistant Examiner*—Alison K. Pichard
(74) *Attorney, Agent, or Firm*—Cox & Smith Incorporated

(57) ABSTRACT

A device and method for sealing a first cylinder in a fixed position inside a second concentric cylinder. The inner cylinder has an annular depression in its wall at the point of sealant placement, which causes the wall of the inner cylinder to intrude inwardly. The depression is filled with a partially compressible fluid and is covered over by a malleable/ductile sleeve. The inner cylinder is placed within the outer cylinder with the covered annular depression positioned at the desired sealing point. A cylindrical displacement device is directed through the inside of the inner cylinder where it encounters the intrusion of the annular depression. The displacement device is forced past the annular intrusion and pushes the wall outward. The partially compressible fluid is forced to expand outward under the malleable/ductile cover in a manner that intrudes into the annular space between the inner cylinder and the outer cylinder and into contact with the outer cylinder. The partially compressible fluid has a residual energy sufficient to maintain the sealing element in contact with the outer cylinder.

19 Claims, 5 Drawing Sheets

METHOD AND APPARATUS FOR EXPANSION SEALING CONCENTRIC TUBULAR STRUCTURES

BACKGROUND OF THE INVENTION

1. Field of the Invention

The present invention relates generally to methods and devices for positioning and sealing concentric tubular members with respect to each other. The present invention relates more specifically to methods and devices for creating differential movement and storing residual energy of sufficient volume and magnitude for hanging, sealing, or packing the annular space between a first tubular structure, such as a well casing, and a second tubular structure such as a pipe string.

2. Description of the Related Art

There are many environments within which concentric tubular elements are utilized to conduct the flow of various fluids and the like to and from fluid sources. Oil and gas well boreholes provide an example of one such environment. In many drilling operations it is desirable to provide casing within the well and to additionally segment or segregate portions of the cased borehole in order to access various formations encountered by the well. Segregation of a cased borehole (or even an uncased well in some instances) may be accomplished by any of a number of mechanisms for sealing or packing the annular space around the inner tubular structure between that inner tubular and the outer tubular structure (the casing). In other circumstances it is additionally desirable to provide fixed contact between an inner tubular member and an outer tubular member for the purpose of suspending or hanging the weight of a pipe string or tool section at a point within the borehole other than at a surface structure.

As indicated above, there are many mechanisms and methods for sealing, packing, and/or hanging a first tubular member inside a second tubular member. Factors such as drill string weight, borehole pressure, borehole temperature, drilling fluid composition, as well as the purpose of the packing, all contribute to the selection of a mechanism and method that works best in a given environment. In some applications removal of a seal or segregation is a requirement that dictates a generally more complex mechanism. High pressures and temperatures dictate sealant surfaces that are resistant to degradation under such conditions. Most often, the strength, structure and operation of a packing mechanism is dictated by the amount of weight that the point of casing contact is called upon to support.

The placement of permanent packers and the like, in a combination of tubular elements, may involve structures that utilize mechanical compression setting tools, hydraulic pressure devices, inflatable charges, or inflatable sealing elements with cement or other materials injected therein. One result dictated by some of the various factors mentioned above has been the development of structurally heavy and complex mechanisms for the placement of a casing seal especially those intended to be removable. A large category of such packing devices comprise radial arrays of wedge elements that may be forced outward into contact with the inner walls of the casing to establish a fixation of the inner tubular with respect to the casing and in some instances to establish an annular seal between the inner tubular and the casing. There are various mechanisms for activating these wedges through manipulation of the drill string or through remote operation of hydraulic or electric devices from the surface. In many instances a longitudinal compression of the drill string (which can be accomplished in a variety of ways) acts to force plates, wedges or other movable surfaces outward from the inner tubular to make contact with the casing or outer tubular. In other designs, counter-rotation of the drill string can serve to activate (or deactivate) the outward movement of the contact wedges or plates. The general rule for such structures is one of greater and greater mechanical complexity in order to assure operation and a tight fit against the casing wall. Complexity, however, leads to unreliability and failure which, if occurring many thousands of feet underground, can result in millions of dollars of recovery and retrieval costs.

Complexity also fails in environments where multiple seal placements are required. It is often necessary in borehole operations to place a number of seals in order to adequately segregate the various formations of interest. Once a first seal has been made subsequently placed "lower" seals must be manipulated through the first "upper" seal. This means that the packer device must be smaller in initial configuration in order to fit through the first seal placement. The more complex the device the less it lends itself to reductions in size sufficient to permit such multiple seal placements.

While oil and gas drilling operations provide a prime example of the need to establish concentric tubular zones and sections, other industries and environments also have need for mechanisms of this type. Certainly other forms of drilling operations often require the placement of inner tubular structures within concentric outer tubular structures. Pipeline operations, both inside and outside plant, often require the use of concentric tubular elements and the proper sealing of such elements together, often from a remote location.

It would be desirable to have an apparatus and method for the placement, positioning and sealing of a first tubular member in a fixed position with respect to a second concentric tubular member in a manner that provides a durable seal placement that resists degradation over time and exposure to high temperature and pressure environments. It would be desirable if such a system were simple in construction so as to reduce the chances of its failure to operate when utilized at a distance from an activating mechanism. It would be desirable to define a system whose basic concepts of operation were applicable in a variety of industrial environments and a range of structural geometries.

SUMMARY OF THE INVENTION

It is therefore an object of the present invention to provide an apparatus for the placement, positioning and sealing of a first tubular member in a fixed position with respect to a second concentric tubular member.

It is an object of the present invention to provide a packing type device for the placement, positioning and sealing of tubular members in a permanent manner that resists degradation of the seal over time.

It is an object of the present invention to provide a packing type device for the placement, positioning and sealing of tubular members in a permanent manner that resists degradation of the seal when exposed to high temperature and high pressure environments.

It is a further object of the present invention to provide a sealing system for use between concentric tubular members that seals the annular space between the tubular members and fixes the position of the tubular members with respect to each other, with a seal that retains its resiliency or internal pressure over time.

It is a further object of the present invention to provide a sealing device that may be moved to a position within an outer tubular member without significant damage to the surface area associated with the seal during the placement process.

It is a further object of the present invention to provide a method for placing, positioning and sealing a first tubular member in a fixed position with respect to a second concentric tubular member.

It is a further object of the present invention to provide a seal placement method that may be implemented from a remote location but which involves a mechanical simplicity that reduces the likelihood of operational failure.

It is a further object of the present invention to provide a method for the placement of a seal between tubular members that requires only a simple structural linkage between the point of seal placement and the point from which the operation of the process is directed.

In fulfillment of these and other objectives the present invention provides an apparatus and method for the placement and sealing of a first tubular member in a fixed position with respect to a second concentric tubular member. The system of the invention utilizes an inner tubular member formed with a shallow annular depression in the tube wall at the point of sealant placement. The formation of the annular depression causes the wall of the inner tubular member to "intrude" into the otherwise cylindrical passage within the inner tube. On the outer surface of the first inner tubular member the depression is filled with a partially compressible fluid. The annular depression and the partially compressible fluid are then covered over by a malleable/ductile sleeve that serves to complete the cylindrical outer wall of the inner tubular member while maintaining an outside diameter less than the inside diameter of the outer tubular member. Placement of the seal involves first positioning the inner tubular member within the outer tubular member and moving the inner tube longitudinally within the outer tube until the covered annular depression is positioned at the desired sealing point. Activation of the seal involves directing a cylindrical or expanding roller displacement device through the inside of the inner tubular member to the point at which the displacement device encounters the "intrusion" of the wall of the inner tube caused by the annular depression formed in the inner tube wall. The displacement device is forced past the annular intrusion in a manner that pushes the wall of the inner tube outward to effectively remove the annular depression and straighten the cylindrical wall of the tube to permit the passage of the displacement device there through. At the same time the partially compressible fluid is forced to expand outward under the malleable/ductile cover in a manner that intrudes into the annular space between the inner tube and the outer tube. This expansion pushes the malleable/ductile cover into contact with the inner wall of the outer tubular member, which contact increases in area and force as the partially compressible fluid therein continues to be pressured from within by the displacement of the wall of the inner tubular member caused by the movement of the displacement device. The partially compressible fluid has a residual energy sufficient to maintain the sealing element in intimate contact with the outer casing wall.

DETAILED DESCRIPTION OF THE PREFERRED EMBODIMENTS

As indicated above, the structures and methods of the present invention lend themselves to use in a variety of industrial applications in both pipeline environments and borehole environments. The following descriptions and the appended drawings relate primarily to an application of the present invention to the borehole environment. It will be understood by those skilled in the art that similar implementations of the structures and methods described are possible in other pipeline and tubular component applications.

Figure 1:
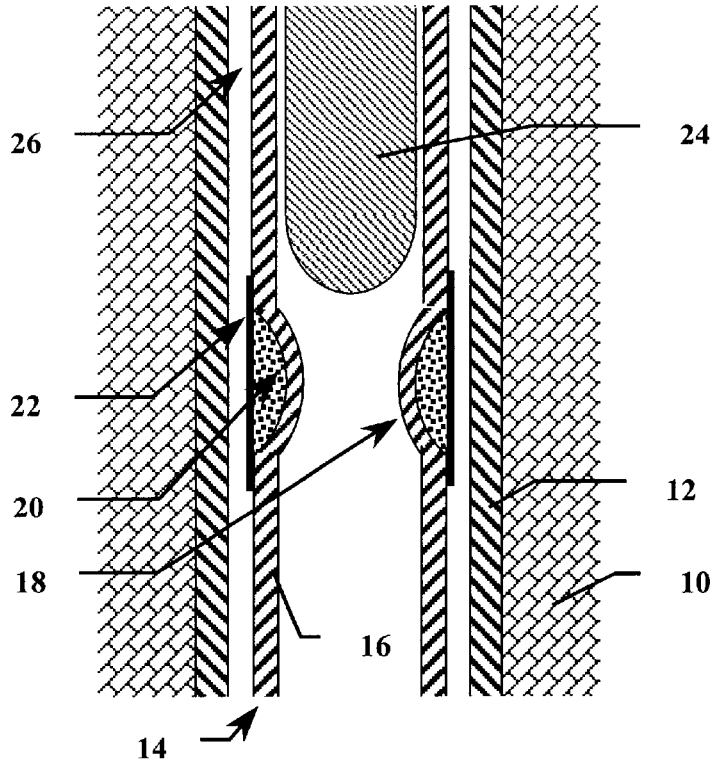
FIG. 1 is a cross sectional view of the structure of the present invention assembled and positioned for placement.
Figure 2:
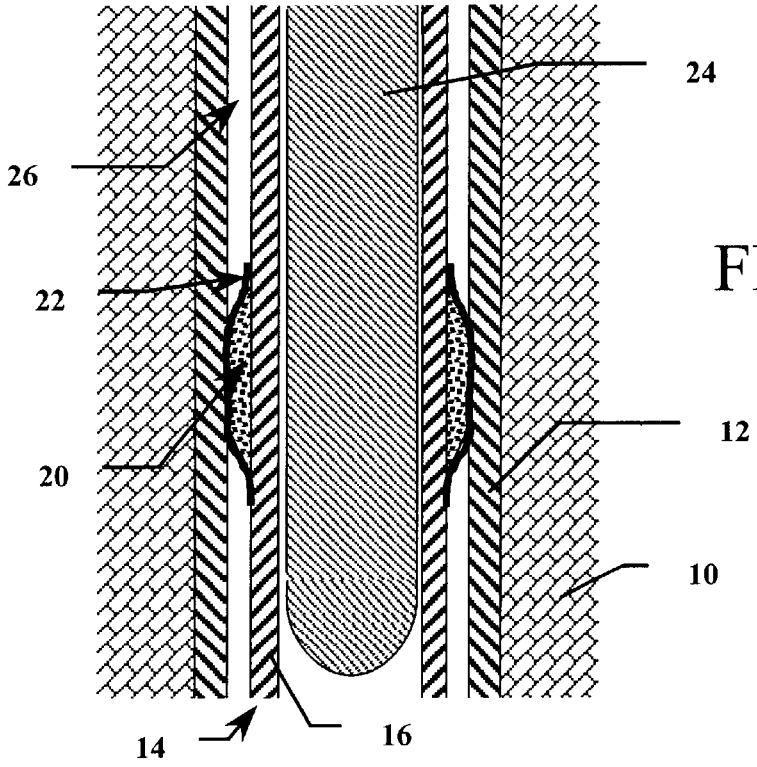
FIG. 2 is a cross sectional view of the structure of the present invention as disclosed in FIG. 1 shown in a deployed or expanded condition.

Reference is made first to FIGS. 1 and 2 for a detailed description of the structure and function of a first preferred embodiment of the present invention. Both FIGS. 1 and 2 show, in a cross sectional view, the positioning and placement of the sealing element of the present system. Both figures show borehole formation 10 confined by casing 12 which forms the outer tubular element in the present invention. Outer tubular casing element 12 is a cylindrical shell installed in the borehole according to any of a number of methods well known in the art. Positioned concentrically within casing 12 is inner tubular element 14. Inner tubular element 14 may, in the borehole environment shown, constitute a pipe string section or a drill tool element. Inner tubular element 14 is inserted longitudinally into outer tubular casing element 12 from an open end thereof and is positioned as appropriate concentrically within outer tubular casing element 12 at a longitudinal point appropriate for placing the seal. Longitudinal positioning of the seal may be accomplished by any of a number of well-known methods for tracking the distance into the borehole by a pipe string member.

Inner tubular element 14 is initially constructed such that inner tubular wall 16 is deformed or depressed in an annular manner at annular depression 18. Both the formation of this annular depression 18 in tubular wall 16 and the subsequent straightening of the wall, as shown in FIG. 2, require that the material of which tubular element 14 is constructed be relatively malleable/ductile while at the same time is of sufficient section and strength to support the structure and weight of the tubular element as a whole. In the preferred embodiment, inner tubular element 14 is constructed of a tubular metal component comprising any of the steel alloys, nickel alloys, chrome alloys, or nickel-chrome alloys including those that fall under the American Petroleum Institute (API) classification for tubing and casing generally known as "Oil Country Tubular Goods" (OCTG). Placed within annular depression 18 is partially compressible fluid 20 which fills annular depression 18 back to a level in line with the outside diameter of inner tubular element 14.

Surrounding both annular depression 18 and partially compressible fluid 20 is malleable/ductile cover sleeve 22. Cover sleeve 22 is sized to be larger than annular depression 18 in the longitudinal direction but having an inside diameter approximately equal to the outside diameter of inner tubular element 14. In this manner a tight fit sleeve is positioned over annular depression 18 covering and containing partially compressible fluid 20. The outside diameter of malleable/ductile cover sleeve 22 is still less than the inside diameter of casing 12 forming annular space 26 there between. This permits the easy placement of inner tubular element 14 within outer tubular casing element 12.

Finally shown in FIG. 1 is displacement device 24 positioned above or apart from the sealing element components described as it would be placed prior to implementation of the seal. Displacement device 24 in the preferred embodiment is a solid cylindrical rod or a series of expanding rollers having an outside diameter that becomes only slightly less than the inside diameter of inner tubular element 14. Such a combination of dimensions means that annular depression 18 creates an obstruction within the internal space of inner tubular element 14 that would normally bar the easy passage of displacement device 24 there through. This, of course, is critical to the operation to the sealing element of the present invention as is described in more detail below.

Reference is made to FIG. 2 for the same view shown in FIG. 1 after the process of expanding the sealing element is carried out. In FIG. 2, displacement device 24 is forced through the obstruction created by annular depression 18 in a manner that forces the malleable/ductile inner tubular wall 16 outward, returning to a cylindrical configuration typical of the balance of inner tubular element 14. The passage of displacement device 24 through the obstruction created by annular depression 18 forces tubular wall 16 outward into partially compressible fluid 20. This force, acting through partially compressible fluid 20, likewise exerts an outward force on malleable/ductile cover sleeve 22 expanding it outward. Malleable/ductile cover sleeve 22 is constructed of a material with sufficient malleability/ductility and formability so as to expand into annulus 26 surrounding inner tubular element 14 to a point where cover sleeve 22 contacts the inside wall of outer tubular casing element 12. Continued pressure transmitted through partially compressible fluid 20 serves to force malleable/ductile cover sleeve 22 against the inside wall of tubular casing element 12 effectively sealing annulus 26 at that point. As shown in FIG. 2, it is anticipated that with proper sleeve malleability/ductility and size, the seal thus formed would extend some length in a longitudinal direction along the inside surface of the casing wall.

After placement of the seal as shown and described in FIG. 2, displacement device 24 may be removed from inner tubular element 14 or it may proceed further into tubular element 14 for the placement of a second or further seal within the casing. As indicated above, there are environments within which multiple seals, for the purposes of isolating different formations within a borehole, are appropriate.

Figure 3:
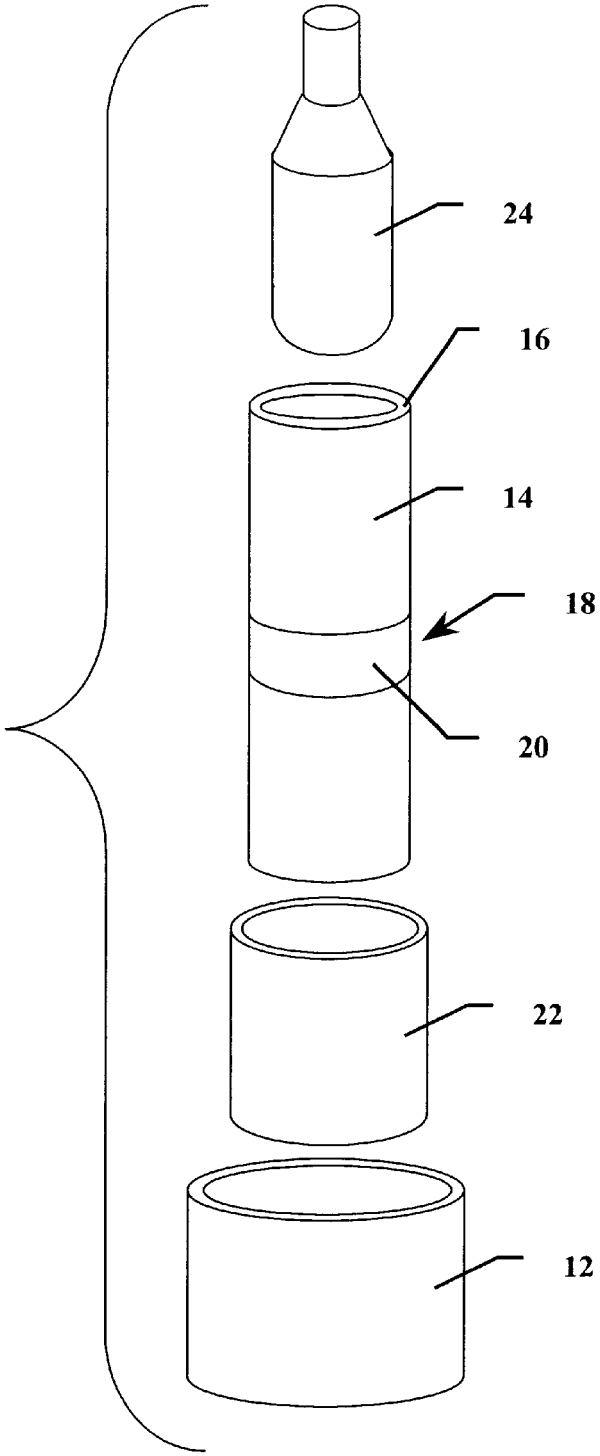
FIG. 3 is an exploded perspective view of the assembly of the present invention.

Reference is now made to FIG. 3 for a brief description of the assembly of the sealing element structure of the present invention. Shown in FIG. 3 are the components both pre-assembled prior to the combination of the tubular elements as well as the components that go together to form the sealing element itself. In FIG. 3 a representative section of inner tubular element 14 is disclosed. Positioned on inner tubular element 14, but hidden by partially compressible fluid 20, is annular depression 18. Partially compressible fluid 20 fills the cavity formed on the outer surface of inner tubular element 14 by annular depression 18. In this manner, a complete cylindrical surface is provided on the outside of inner tubular element 14.

About this cylindrical surface thus formed is positioned malleable/ductile cover sleeve 22. It is understood that malleable/ductile cover sleeve 22 would be pre-positioned and installed about inner tubular element 14 in a manner that covers and contains partially compressible fluid 20. There are a variety of mechanisms for installing malleable/ductile cover sleeve 22 tightly on inner tubular element 14 so as to cover and contain partially compressible fluid 20 and annular depression 18. A involve would heating malleable/ductile cover sleeve 22 so as to expand its inside diameter to a point where sleeve 22 easily slides over the outside diameter of inner tubular element 14. Upon cooling, malleable/ductile cover sleeve 22 shrinks to a tight fit in a proper position on inner tubular element 14.

This assembly of inner tubular element 14, partially compressible fluid 20, and malleable/ductile cover sleeve 22, is inserted longitudinally into outer tubular casing element 12. FIG. 3 is intended to be schematic in nature as it is anticipated that inner tubular element 14 would be quite long in comparison to its width and would extend well into casing 12 to a point where the seal would be expanded. The components, as disclosed in FIG. 3 therefore, are abbreviated in their longitudinal dimension.

Once inner tubular element 14 is inserted into casing element 12 and properly positioned at the point at which the seal is to be formed, displacement device 24 is inserted into the inside diameter of inner tubular element 14. As indicated above, the dimensions of displacement device 24 are such that movement of the displacement device longitudinally through the standard inside dimensions of inner tubular element 14 may be easily accomplished. Only the obstruction formed by annular depression 18 would block the passage of displacement device 24 there through. The leading edge of displacement device 24 is shaped so as to permit the gradual displacement of inner tubular wall 16 at annular depression 18 outward as described above.

Figure 4A:
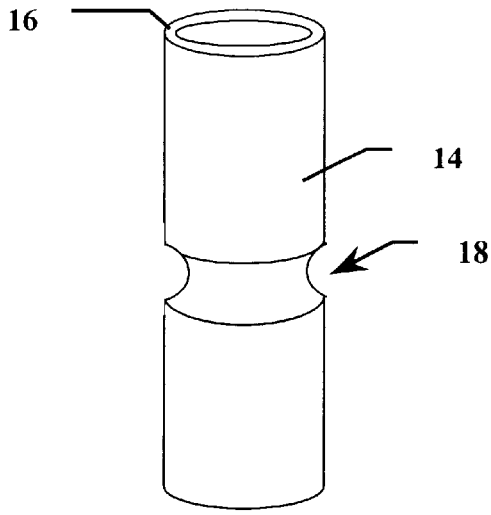
FIG. 4*a* is a perspective detail view showing the formation of the deformable depression according to a first preferred structure.
Figure 4B:
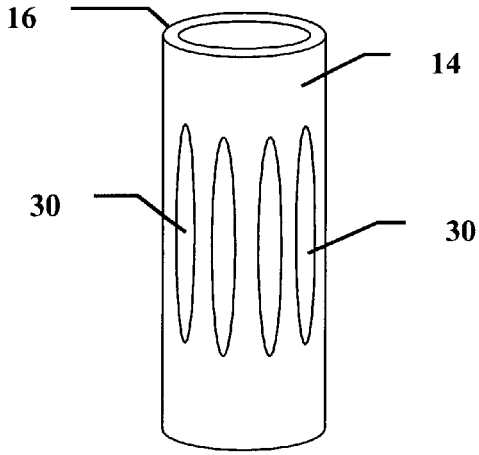
FIG. 4*b* is a perspective detail view showing the formation of the deformable depression according to a second preferred structure.

Reference is now made to FIGS. 4*a* and 4*b* for a description of two alternate but similar configurations for the creation of an appropriate depression in the tubular wall of inner tubular element 14. In FIG. 4*a* the standard configuration described above is disclosed. In this view, inner tubular element 14 is shown with annular depression 18 formed therein. As indicated above, inner tubular wall 16 is of a thickness and malleability/ductility such that annular depression 18 may be easily formed by a variety of known methods. The formation of annular depression 18 may be readily accomplished by appropriate heating and rolling or cold forming of inner tubular element 14 against a rigid disc (as an example) sized so as to gradually depress the wall of inner tubular element 14 into its interior space. Partially compressible fluid 20 (not shown) would then be positioned within annular depression 18 as described above.

FIG. 4*b* discloses an alternative method for creating depressions in inner tubular element 14 suitable for the retention of partially compressionable fluid 20. In FIG. 4*b*, an array 30 of longitudinal depressions is formed in the wall of inner tubular element 14 in place of the annular depression described above. Such longitudinal depressions may likewise be created by appropriate heating and rolling or cold forming of this section of inner tubular element 14 against a rigid disc form or the like. Such techniques for creating depressions in tubular sections are well known. As with the structure shown in FIG. 4*a*, partially compressible fluid (not shown) is then positioned in the voids left by longitudinal depressions 30 prior to being covered over by malleable/ductile cover sleeve (not shown).

Figure 5:
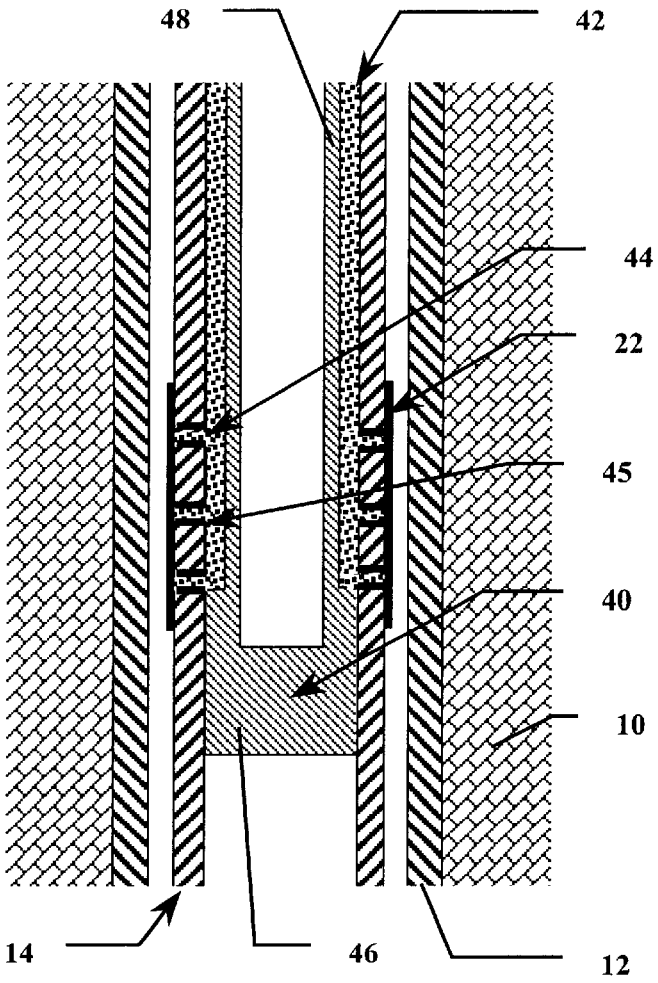
FIG. 5 is a cross sectional view of an alternative structure of the present invention assembled and positioned for placement.

Yet another alternative structure is disclosed in cross sectional detail in FIG. 5. FIG. 5 provides a view similar to that shown in FIGS. 1 and 2 wherein inner tubular element 14 is positioned within borehole formation 10. Outer tubular casing element 12 is positioned against the walls of borehole formation 10 and inner tubular element 14 is inserted therein. In the structural design shown in FIG. 5, the walls of inner tubular element 14 are not deformed but rather are perforated with fluid wall ports 44. Malleable cover sleeve 22 is positioned over fluid wall ports 44 much in the manner that the sleeve is positioned over the partially compressible fluid placed in the annular depression as described above. In this embodiment, the partially compressible fluid 20 is forced under pressure through fluid wall ports 44 (which incorporate check valves 45 to prevent backflow) to a position behind malleable/ductile cover sleeve 22. Being under pressure, partially compressible fluid 20 forces malleable/ductile cover sleeve 22 outward much in the same fashion as described above with the first embodiment. Once again, the geometry and structure of malleable/ductile cover sleeve 22 may be configured to accommodate a given volume of partially compressible fluid 20 forced into the system at high pressure.

Conducting partially compressible fluid 20 down to the position of fluid wall ports 44 is accomplished by means of fluid injection tubular 40. Injection tubular 40 is constructed so as to have a closed end 46 and a tubular component 48. The outside diameter of tubular component 48 is less than the inside diameter of inner tubular element 14. This creates an inner annulus 42 through which partially compressible fluid 20 may flow to reach fluid wall ports 44.

Operation of the system shown in FIG. 5 comprises insertion of the combination of inner tubular element 14 with malleable/ductile cover sleeve 22 into casing 12 to a point where the seal is to be expanded. Fluid injection tubular 40 is then inserted to a point where its closed end 46 is just below fluid wall ports 44 as shown. Partially compressible fluid 20 is then pumped under pressure into inner annulus 42 surrounding fluid injection tubular 40 where it may then flow through fluid wall ports 44 to a point behind malleable/ductile cover sleeve 22 thereby expanding malleable/ductile cover sleeve 22 to a point where it contacts the inside wall of casing 12. The formation of the seal thereafter is essentially the same as that disclosed above with respect to FIGS. 1 and 2.

Figure 6:
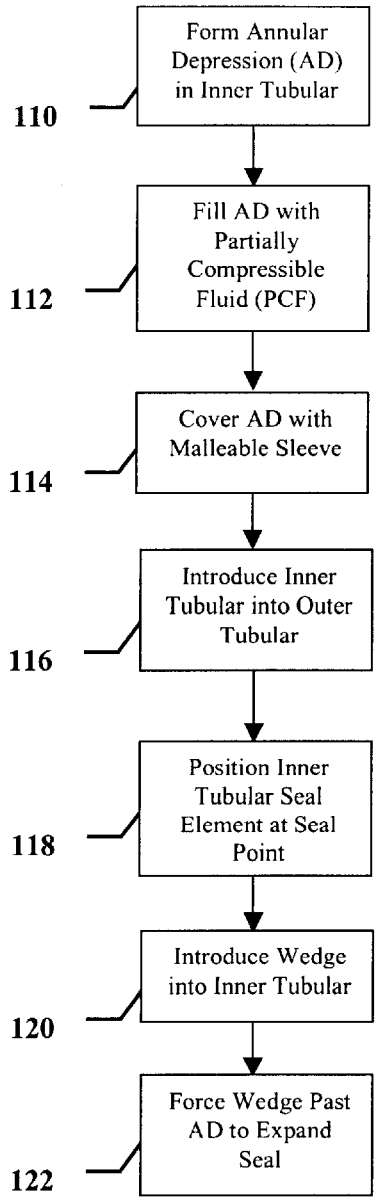
FIG. 6 is a flow chart of the basic steps in the method of the present invention.

Reference is now made to FIG. 6 for a brief description of the method of the implementation of the system of the present invention. The basic method is described in terms both of the preinsertion assembly of the inner tubular element and the expansion of the sealing element once properly positioned. The process begins at Step 110 wherein an annular depression (AD) is formed in the wall of the inner tubular element. As indicated above, there are a number of different well-known methods for deforming the wall of the tubular element into the configuration described herein. Step 112 involves filling the annular depression with the partially compressible fluid (PCF). Various fluid compositions are anticipated as being appropriate for the structure and function of the tool described herein. The primary characteristics of the fluid critical to operation in conjunction with the system of the present invention, are the fluid's compressibility and its retention of a sufficient residual energy under pressure. It is anticipated that the partially compressible fluid element may be either a single material, such as a low density polyethylene or other thermoplastic compound, or may be a combination of an elastomer such as silicon rubber and silicon fluid or other high temperature elastomers and fluids or fluid like materials such as microspheres. In any event, this material is positioned within the depression formed in the wall of the inner tubular element so as to completely fill the cavity formed thereby. At Step 114 the annular depression, with the partially compressible fluid placed therein, is covered with a malleable/ductile sleeve (MS). The method for placement, positioning and attachment of the malleable/ductile sleeve in this manner is described above. Various materials for the malleable/ductile sleeve are anticipated with the critical requirements relating to malleability/ductility and resistance to chemicals likely to be encountered within the borehole environment. Certain gold/gold alloys have been shown and are known in the art to be both appropriately malleable/ductile and resistant to chemicals encountered in the borehole. Other soft metal alloys (such as copper/copper, tin/tin and aluminum/lead) are anticipated to be appropriate as well. Most alloys used in the manufacture of Oil Country Tubular Goods (OCTG) also exhibit properties that allow them to be formed in the same manner, applying higher forces to the forming/displacement devices.

Once the sealing element is constructed as described in Steps 110, 112, and 111, it is introduced into the outer tubular casing as shown above. This introduction of the inner tubular into the outer tubular is accomplished at Step 116. Step 118 comprises positioning the sealing element with respect to a preferred point on the outer tubular element. Again, as indicated above, there are a variety of methods for appropriately identifying the distance the inner tubular element has traveled longitudinally into the outer tubular element. These systems are known to be quite accurate and to position sealing element within a few inches of its desired location.

At Step 120 the displacement device is introduced into the inner tubular element to a point just before the sealing element component thereof. While the displacement device component may, under certain circumstances, be introduced from a remote location all the way through the inner tubular element to the sealing point, it is also anticipated that the displacement device may be previously positioned immediately adjacent to sealing element and inserted into the outer casing at the same time the inner tubular is introduced therein. In either case, the displacement device is positioned at Step 120 immediately adjacent to the obstruction within the inner tubular element formed by the annular depression. A longitudinal force on the displacement device pushes it through the obstruction formed by the annular depression at Step 122, thereby expanding the seal as described above. Further seal expansions may be carried out along a length of the inner tubular structure where multiple isolation zones are required.

DETAILED DESCRIPTION OF ALTERNATIVE PREFERRED EMBODIMENTS

A key feature of the structure of the present invention as described above is the differential movement of the seal element made possible by the geometric design of the fluid storage area. The geometry allows the inner casing to be minimally deformed while still causing a large amount of expansion at the outer seal location. Long but shallow depressions can be used to store large amounts of deployment fluid. The only requirement to the geometry is that the sections of the inner tubular wall and the malleable/ductile cover sleeve be of sufficient strength to resist the hydrostatic pressure developed during deployment and operation of the seal element.

Figure 7:
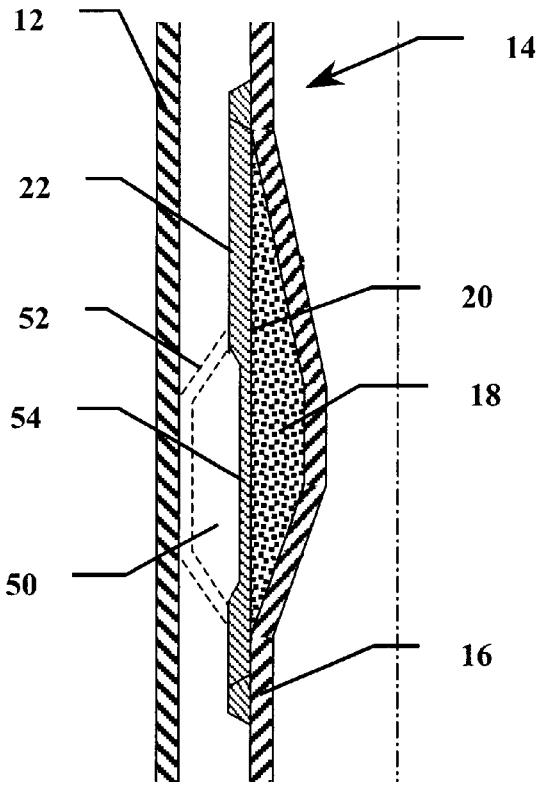
FIG. 7 is a cross sectional detail view of an alternate embodiment of the present invention shown in a deployed and expanded condition.

Reference is made to FIG. 7 for a detailed description of a preferred geometry to the depression formed within the inner tubular wall as described above. In FIG. 7 a detailed cross sectional view of inner tubular wall 16 is shown. Annular depression 18 is shown in cross section as well. Partially compressible fluid 20 is positioned within annular depression 18. It should be noted that annular depression 18, as shown in FIG. 7, is not symmetrical with respect to the circumference of inner tubular wall 16. In other words, the depression is not of semicircular cross section but rather is shallower at one end (edge) and deeper at a second end (edge). The displacement device (not shown in this view) would approach inner tubular wall 16 from the shallower end of annular depression 18. This configuration, combined with a wedge or roller shape to the displacement device, permits the differential movement described above. Only after a significant amount of the partially compressible fluid 20 has been displaced from annular depression 18 does the displacement device encounter the deeper portion of annular depression 18.

In FIG. 7 the cross sectional geometry of annular depression 18 is complimented by a cross sectional thinning of malleable/ductile cover sleeve 22 over the area of annular depression 18 where the expansion seal is intended to be formed. This thinned area 54 in malleable/ductile cover sleeve 22 provides a weak spot in malleable/ductile cover sleeve 22 through which partially compressible fluid 20 is most likely to expand. The dotted line representation shown in FIG. 7 indicates the manner in which malleable/ductile cover sleeve 22 expands at 52 by receiving partially compressible fluid 50 therein. Such expansion makes contact with, and seals against outer tubular casing element 12 in the manner described above.

Figure 8A:
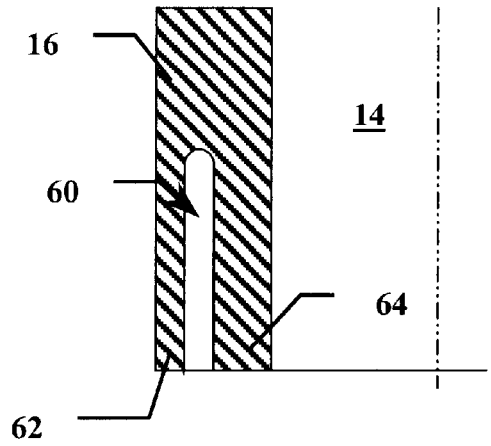
FIG. 8*a* is a cross sectional detailed view of an alternate means for constructing the deformable depression in the inner tubular wall of the present invention.
Figure 8B:
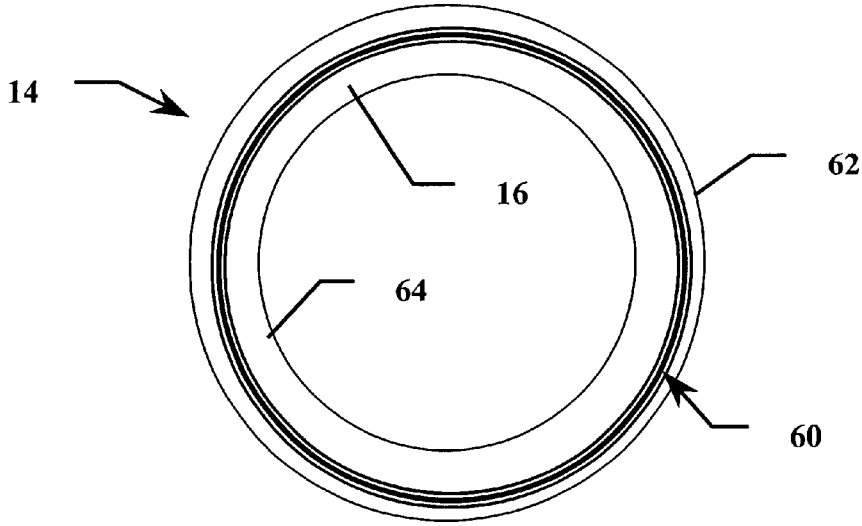
FIG. 8*b* is a cross sectional view across the diameter of the inner tubular element of the present invention showing the formation of the depression shown in FIG. 8*a*.

Reference is now made to FIGS. 8*a* and 8*b* for a description of yet another alternative embodiment for the construction of an integral form of the sealing device of the present invention. FIG. 8*a* is a detailed cross section of a portion of inner tubular wall 16 of inner tubular element 14. In this embodiment inner tubular wall 16 is of multipart construction so as to facilitate the installation of internal depression 60 from an end of the tubular element. FIG. 8*b* shows in profile the end of the tubular element and the position of the internal annular depression constructed. FIG. 8*a* discloses the resultant outer subwall 62 and inner subwall 64 separated by internal depression 60. Internal depression 60 may be readily milled into the end face of inner tubular element 14 according to methods well known in the art. This results in an annular cavity fully contained within inner tubular wall 16 as opposed to being formed by the deformation of inner tubular wall 16.

Figure 9A:
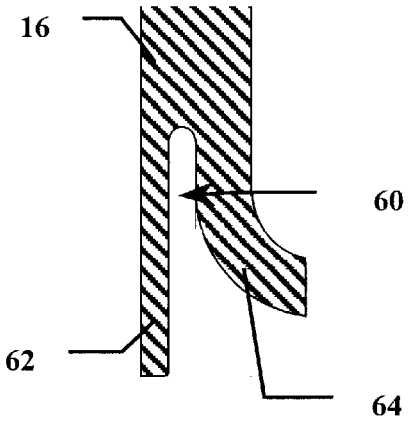
FIGS. 9*a* through 9*c* are detailed cross sectional views of the structure shown in FIG. 8*a* progressively constructed to form a closed seal.
Figure 9B:
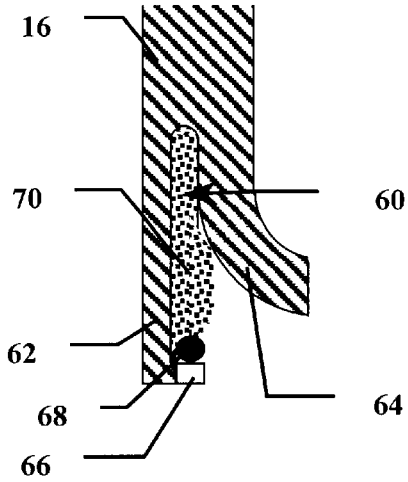
Figure 9C:
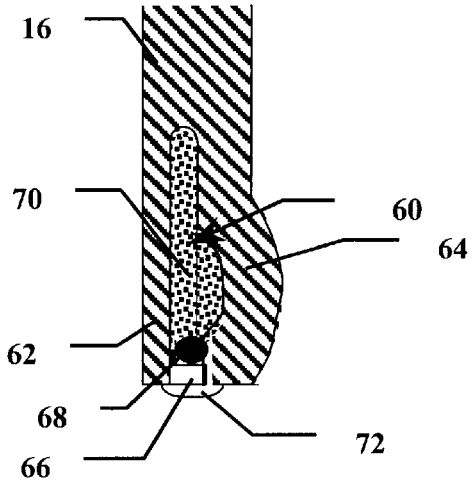

Referring to FIGS. 9*a* through 9*c*, the method for constructing the seal element of this alternative embodiment is shown. In FIG. 9*a* inner subwall 64 is shown rolled inward to create a greater cavity volume and inner profile to internal depression 60. Outer subwall 62 remains undeformed. In FIG. 9*b* partially compressible fluid 70 is positioned within internal depression 60 and partially sealed with O-ring 68. Reference back to FIG. 8*b* makes clear that O-ring 68 is a typically configured O-ring that fits within annular internal depression 60. After O-ring 68 has been put in place, spacer ring 66, having a dimension the same or similar to the original width of internal depression 60 (as shown in FIG. 8*a*), is placed in internal depression 60 to provide a rigid wall closing off internal depression 60.

FIG. 9*c* discloses the final step in the process of creating the internal seal element of the alternative embodiment described. In FIG. 9*c* inner subwall 64 is rolled and deformed back into contact with spacer ring 66 to effectively close off internal depression 60. An appropriate weld 72 more completely seals this enclosure. The result is that inner subwall 64 now remains deformed in a manner that causes it to project into the internal diameter of inner tubular element 14. This results in a construction similar to that described above in the first preferred embodiment of the present invention shown in FIG. 1.

Figure 10:
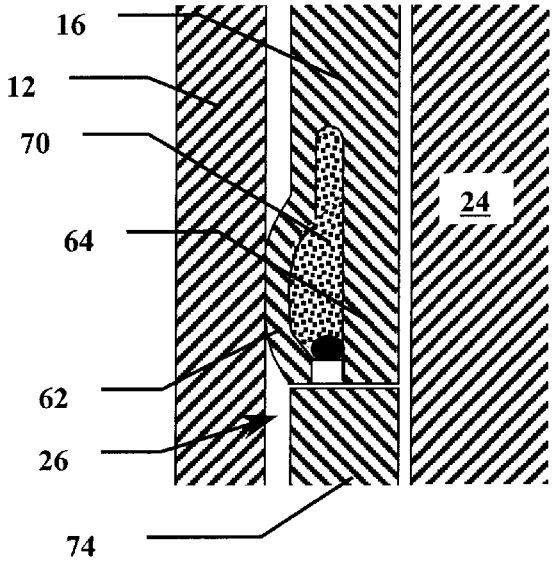
FIG. 10 is a detailed cross sectional view of the structure shown in FIG. 8*a* deployed and expanded within an outer tubular casing element.

Deployment and expansion of the internal seal configuration is shown in FIG. 10. Inner tubular wall 16 with the sealed internal depression 60 and the contained partially compressible fluid 70 is shown positioned within outer tubular casing element 12. Displacement device 24 has been inserted within inner tubular element 14 in the manner described above with the first preferred embodiment. This insertion of displacement device 24 "straightens" inner subwall 64 and forces partially compressible fluid 70 outward against outer subwall 62. Outer subwall 62 deforms outward under the pressure of partially compressible fluid 70 to a point of contact with outer tubular casing element 12 as shown.

As indicated above, the construction in the alternative embodiment just described requires that inner tubular element 14 be a multipart tube. Companion tubular element 74 is shown in FIG. 10 positioned and attached to inner tubular element 14 as a continuation of the inner tubular structure. Such attachment could be by threaded means or any of a number of well known methods in the art.

The benefits of the alternative embodiment just described lie primarily in the elimination of the malleable/ductile cover sleeve previously used to cover over the annular depression formed. In some environments, contact between the inner tubular element and the outer tubular casing element could cause unwanted displacement of the cover sleeve from its position on the inner tubular element. The alternative embodiment just described eliminates the need for the sleeve component that increases, even though slightly, the overall diameter of the inner tubular element.

Although the present invention has been described in conjunction with its implementation in a specific environment, it is anticipated that the basic concepts of the invention translate into structures and geometries appropriate for implementation in a variety of environments. As indicated above, the present description has focused primarily on the application of a system in a borehole environment. It is anticipated that those skilled in the art will readily define modifications of the invention appropriate for its implementation in pipeline and other industrial environments.

We claim:

1. An apparatus for sealing a first tubular element in a fixed position with respect to a second, concentric tubular element, the apparatus comprising:

a first tubular element, said tubular element having a length generally greater than its diameter and having a generally circular cross-section, said first tubular element comprising a cylindrical wall, said cylindrical wall being generally linear and parallel to a longitudinal axis of said tubular element, said cylindrical wall being annularly depressed into an interior of said first tubular element in at least one longitudinal location thereon, said annular depression forming a ring-shaped cavity on an exterior of said first tubular element and a ring-shaped intrusion into said interior of said first tubular element;

a quantity of a partially compressible fluid positioned in said annular depression in said first tubular element;

a malleable/ductile cover sleeve positioned around said first tubular member and covering said partially compressible fluid positioned within said annular depression;

a displacement device positioned within said first tubular element and having an outside dimension incrementally less than said inside diameter of said first tubular element; and means for exerting a longitudinal force on said displacement device so as to direct said displacement device through said first tubular element and past said ring-shaped intrusion into said interior of said first tubular element, said displacement device forcing an expansion of said cylindrical walls of said first tubular element at said annular depression thereby forcing said partially compressible fluid against said malleable/ductile sleeve and expanding said malleable/ductile sleeve into an annular space between said first tubular element and said second tubular element to at least a point where said expanded sleeve contacts an inside wall surface of said second tubular member.

2. The apparatus of claim 1 wherein said annular depression formed in said first tubular element is further defined by a first annular edge and a second annular edge, a depth of said annular depression adjacent said first annular edge being generally greater than a depth of said annular depression adjacent said second annular edge.

3. The apparatus of claim 1 wherein said partially compressible fluid comprises a thermoplastic compound.

4. The apparatus of claim 1 wherein said partially compressible fluid comprises a combination of a high temperature elastomer compound and a fluid elastomer compound.

5. The apparatus of claim 4 wherein said partially compressible fluid comprises a combination of a silicon rubber compound and a silicon fluid compound.

6. The apparatus of claim 4 wherein said partially compressible fluid comprises a combination of a high temperature elastomer compound and a quantity of microspheres.

7. The apparatus of claim 1 wherein said partially compressible fluid comprises a low density polyethylene compound.

8. The apparatus of claim 1 wherein said displacement device comprises a solid cylindrical wedge having an outer diameter less than an inner diameter of said first tubular element.

9. The apparatus of claim 1 wherein said displacement device comprises a mechanical roller assembly having an overall diameter less than an inner diameter of said first tubular element.

10. An apparatus for sealing a first tubular element in a fixed position with respect to a second, concentric tubular element, the apparatus comprising:

a first tubular element, said tubular element having a length generally greater than its diameter and having a generally circular cross-section, said first tubular element comprising a cylindrical wall, said cylindrical wall being generally linear and parallel to a longitudinal axis of said tubular element, said cylindrical wall having a plurality of ports arranged at a longitudinal position thereon, said ports providing liquid communication through said cylindrical wall of said first tubular element;

a quantity of a partially compressible fluid comprising a thermoplastic compound;

a malleable/ductile cover sleeve positioned around said first cylinder and covering said plurality of ports positioned in said cylindrical wall of said first cylinder; and means for directing said partially compressible fluid under pressure through said plurality of ports thereby forcing said partially compressible fluid against said malleable/ductile sleeve and expanding said malleable/ductile sleeve into an annular space between said first tubular element and said second tubular element to at least a point where said expanded sleeve contacts an inside wall surface of said second tubular member.

11. An apparatus for sealing a first tubular element in a fixed position with respect to a second, concentric tubular element, the apparatus comprising:

a first tubular element, said tubular element having a length generally greater than its diameter and having a generally circular cross-section, said first tubular element comprising a cylindrical wall, said cylindrical wall being generally linear and parallel to a longitudinal axis of said tubular element, said cylindrical wall having a plurality of ports arranged at a longitudinal position thereon, said ports providing liquid communication through said cylindrical wall of said first tubular element;

a quantity of a partially compressible fluid comprising a low density polyethylene compound;

a malleable/ductile cover sleeve positioned around said first cylinder and covering said plurality of ports positioned in said cylindrical wall of said first cylinder; and means for directing said partially compressible fluid under pressure through said plurality of ports thereby forcing said partially compressible fluid against said malleable/ductile sleeve and expanding said malleable/ductile sleeve into an annular space between said first tubular element and said second tubular element to at least a point where said expanded sleeve contacts an inside wall surface of said second tubular member.

12. An apparatus for sealing a first tubular element in a fixed position with respect to a second, concentric tubular element, the apparatus comprising:

a first tubular element, said tubular element having a length generally greater than its diameter and having a generally circular cross-section, said first tubular element comprising a cylindrical wall, said cylindrical wall being generally linear and parallel to a longitudinal axis of said tubular element, said cylindrical wall having a plurality of ports arranged at a longitudinal position thereon, said ports providing liquid communication through said cylindrical wall of said first tubular element;

a quantity of a partially compressible fluid comprising a combination of a high temperature elastomer compound and a fluid elastomer compound;

a malleable/ductile cover sleeve positioned around said first cylinder and covering said plurality of ports positioned in said cylindrical wall of said first cylinder; and means for directing said partially compressible fluid under pressure through said plurality of ports thereby forcing said partially compressible fluid against said malleable/ductile sleeve and expanding said malleable/ductile sleeve into an annular space between said first tubular element and said second tubular element to at least a point where said expanded sleeve contacts an inside wall surface of said second tubular member.

13. The apparatus of claim 12 wherein said partially compressible fluid comprises a combination of a silicon rubber compound and a silicon fluid compound.

14. The apparatus of claim 12 wherein said partially compressible fluid comprises a combination of a high temperature elastomer compound and a quantity of microspheres.

15. An apparatus for sealing a first tubular element in a fixed position with respect to a second, concentric tubular element, the apparatus comprising:

a first tubular element, said tubular element having a length generally greater than its diameter and having a generally circular cross-section, said first tubular element comprising a cylindrical wall, said cylindrical wall being generally linear and parallel to a longitudinal axis of said tubular element, said cylindrical wall having an annular inclusion formed in an end thereof, said annular inclusion extending into said cylindrical wall in a direction generally parallel to said longitudinal axis of said tubular element, said annular inclusion forming a ring-shaped cavity interior to said first tubular element and a resultant ring-shaped intrusion into said interior of said first tubular element, said ring-shaped cavity enclosed by an outer subwall formed from said cylindrical wall and an inner subwall formed from said cylindrical wall;

a quantity of a partially compressible fluid positioned in said annular inclusion in said first tubular element between said inner and outer subwalls thereof;

a displacement device positioned within said first tubular element and having an outside dimension incrementally less than said inside diameter of said first tubular element; and means for exerting a longitudinal force on said displacement device so as to direct said displacement device through said first tubular element and past said ring-shaped intrusion into said interior of said first tubular element, said displacement device forcing an expansion of said inner subwall of said cylindrical wall of said first tubular element at said annular inclusion thereby forcing said partially compressible fluid against said outer subwall and expanding said outer subwall into an annular space between said first tubular element and said second tubular element to at least a point where said expanded outer subwall contacts an inside wall surface of said second tubular member.

16. The apparatus of claim 15 further comprising an O-ring seal positioned in said annular inclusion and serving to facilitate the retention of said partially compressible fluid therein.

17. The apparatus of claim 16 further comprising a rigid ring seal positioned in said annular inclusion and serving to facilitate the retention of said partially compressible fluid therein, said rigid ring seal being welded to said outer subwall and to said inner subwall.

18. A method for sealing a first tubular element in a fixed position with respect to a second, concentric tubular element, the method comprising the steps of:

forming at least one annular depression into a wall of said first tubular element in at least one location thereon, said annular depression forming a ring-shaped cavity on an exterior of said first tubular element and a ring-shaped intrusion into an interior of said first tubular element;

positioning a quantity of a partially compressible fluid into said annular depression formed in said first tubular element;

positioning a malleable/ductile cover sleeve around said first tubular element and covering said partially compressible fluid positioned within said annular depression;

introducing said first tubular element with said partially compressible fluid and said malleable/ductile cover sleeve into said second tubular element;

positioning said malleable/ductile cover sleeve, in place on said first tubular element at a point within said second tubular element where said sealing is to be placed;

introducing a displacement device into said first tubular element and positioning said displacement device adjacent to said ring-shaped intrusion within said first tubular element; and exerting a longitudinal force on said displacement device so as to direct said displacement device through said first tubular element and past said ring-shaped intrusion, said displacement device forcing an expansion of said cylindrical walls of said first tubular element at said annular depression thereby forcing said partially compressible fluid against said malleable/ductile sleeve and expanding said malleable/ductile sleeve into an annular space between said first tubular element and said second tubular element to at least a point where said expanded sleeve contacts said inside surface of said second tubular element.

19. The method of claim 18 wherein said step of forming at least one annular depression comprises forming a shallow portion of said depression and an adjacent deep portion of said depression and wherein said step of introducing a displacement device into said first tubular element comprises first introducing said displacement device against said shallow portion of said depression and progressively introducing said displacement device against said deep portion of said depression.

* * * * *